US007380545B2

(12) United States Patent
Shieh et al.

(10) Patent No.: US 7,380,545 B2
(45) Date of Patent: Jun. 3, 2008

(54) OIL DRAIN DEVICE FOR AN ENGINE OIL SEPARATOR

(75) Inventors: Teng-Hua Shieh, Ann Arbor, MI (US); Shohei Nomura, Ann Arbor, MI (US); Naveen Rajan, Ann Arbor, MI (US)

(73) Assignee: Toyota Motor Engineering & Manufacturing North America, Inc., Erlanger, KY (US)

( * ) Notice: Subject to any disclaimer, the term of this patent is extended or adjusted under 35 U.S.C. 154(b) by 52 days.

(21) Appl. No.: 11/533,813

(22) Filed: Sep. 21, 2006

(65) Prior Publication Data

US 2007/0181108 A1 Aug. 9, 2007

Related U.S. Application Data

(63) Continuation-in-part of application No. 11/350,422, filed on Feb. 9, 2006.

(51) Int. Cl.
*F02B 25/06* (2006.01)

(52) U.S. Cl. ..... 123/572

(58) Field of Classification Search ..... 123/572–574, 123/41.86

See application file for complete search history.

(56) References Cited

U.S. PATENT DOCUMENTS 4,156,406 A * 5/1979 Brandau et al. ..... 123/41.86
4,627,406 A * 12/1986 Namiki et al. ..... 123/573
5,022,376 A * 6/1991 Hudson et al. ..... 123/572
6,412,478 B1 * 7/2002 Ruehlow et al. ..... 123/572
6,435,170 B1 * 8/2002 Hamelink et al. ..... 123/572

FOREIGN PATENT DOCUMENTS

JP 07-066876 3/1995

* cited by examiner

*Primary Examiner*—M. McMahon
(74) *Attorney, Agent, or Firm*—Gifford, Krass, Sprinkle, Anderson & Citkowski, P.C.

(57) ABSTRACT

An oil separator separates oil from crankcase gases of an internal combustion engine. The oil drainage device includes an inlet, an outlet and a plurality of stages arranged in a stack between the inlet and the outlet. Each stage includes a generally upright side wall having opposite top and bottom faces. An end wall is disposed at the bottom face of the side wall. The end wall has opposite upper and lower surfaces. The end wall has a bore extending through the upper and lower surfaces for receiving a flow of crankcase gases therethrough. A plate diverts the flow of crankcase gases exiting the bore for creating a pressure increase that separates oil from the crankcase gases. A tube extends through the bore for directing the flow of crankcase gases therethrough. The tube being spaced apart from an inner surface of the bore allowing oil to flow therethrough in an opposite direction relative to the crankcase gases.

12 Claims, 6 Drawing Sheets

FIG - 2
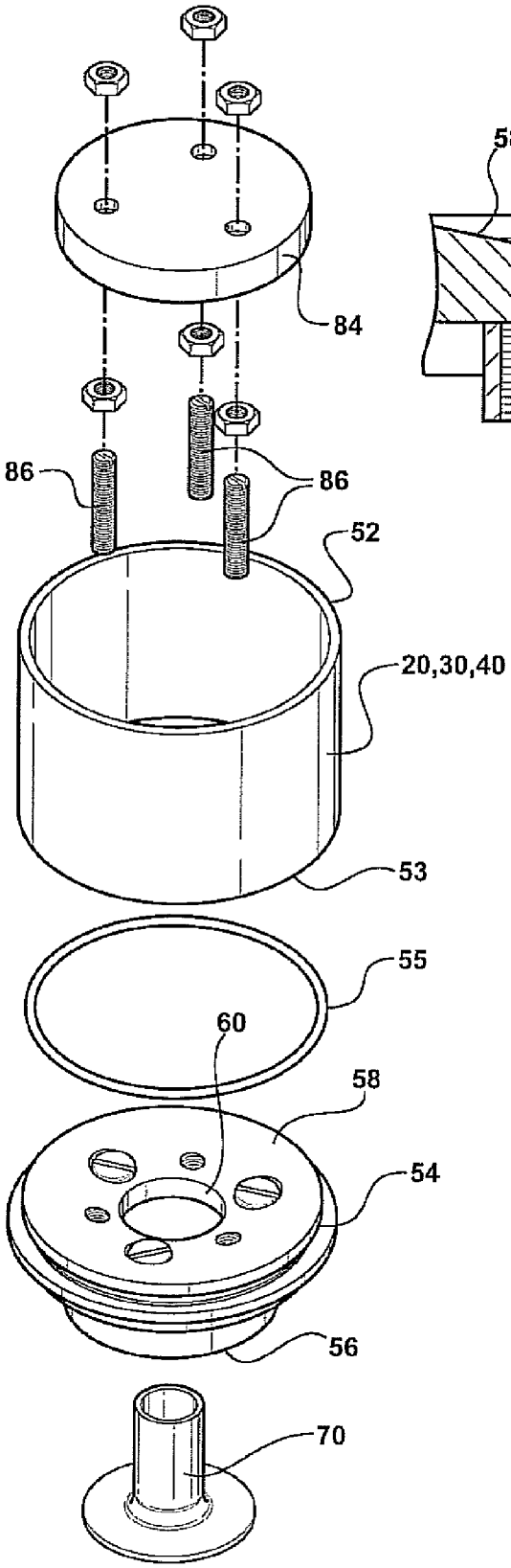
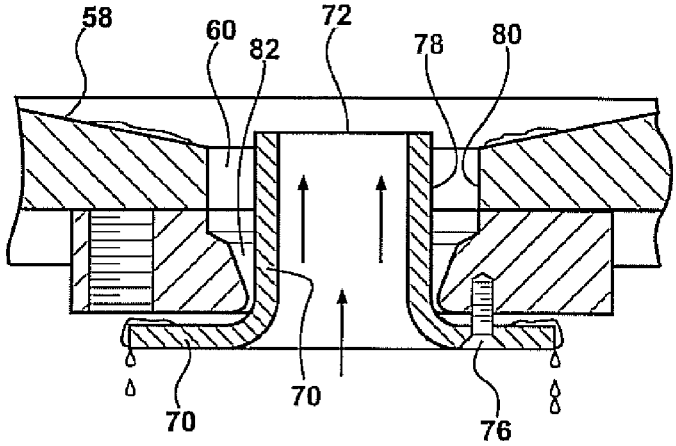
FIG - 3

OIL DRAIN DEVICE FOR AN ENGINE OIL SEPARATOR

CROSS REFERENCE TO RELATED APPLICATIONS

This application is a continuation-in-part of U.S. patent application Ser. No. 11/350,422 filed on Feb. 9, 2006, the contents of which are incorporated herein by reference in its entirety.

BACKGROUND OF THE INVENTION

1. Field of the Invention

The invention relates to an oil separator for separating oil from crankcase gases of an internal combustion engine.

2. Description of the Related Art

An internal combustion engine typically includes a combustion chamber, where a fuel air mixture is burned to cause movement of a set of reciprocating pistons, and a crankcase, which contains the crankshaft driven by the pistons. During operation, it is normal for the engine to experience "blow-by," wherein combustion gases leak past the piston-cylinder gap from the combustion chamber and into die crankcase. These blow-by or crankcase gases contain moisture, acids and other undesired by-products of the combustion process.

An engine typically includes a Positive Crankcase Ventilation (PCV) system for removing harmful gases from the engine and prevents those gases from being expelled into the atmosphere. The PCV system does this by using manifold vacuum to draw vapors from the crankcase into the intake manifold. Vapor is then carried with the fuel/air mixture into an intake manifold of the combustion chambers where it is burned. Generally, the flow or circulation within the system is controlled by the PCV valve, which acts as both a crankcase ventilation system and as a pollution control device.

It is normal for crankcase gases to also include a very fine oil mist. The oil mist is carried by the PCV system to the manifold. The oil mist is then burned in the combustion chamber along with the fuel/air mixture. This results in an increase in oil consumption. A known method of removing oil from the crankcase gases is to use an oil separator. The crankcase gases flow through the oil separator. Localized high pressure areas in the oil separator promote separation of oil from the gases. The oil is re-introduced back to a sump via a drain device. The sump generally holds excess oil in the system.

It remains desirable to provide an improved oil separator that is more efficient than conventional oil separator designs in the removal of oil from crankcase gases.

SUMMARY OF THE INVENTION

According to one aspect of the invention, an oil separator is provided for separating oil from crankcase gases of an internal combustion engine. The oil drainage device includes an inlet, an outlet and a plurality of stages arranged in a stack between the inlet and the outlet. Each stage includes a generally upright side wall having opposite top and bottom faces. An end wall is disposed at the bottom face of the side wall. The end wall has opposite upper and lower surfaces. The end wall has a bore extending through the upper and lower surfaces for receiving a flow of crankcase gases therethrough. A plate diverts the flow of crankcase gases exiting the bore for creating a pressure increase that separates oil from the crankcase gases. A tube extends through the bore for directing the flow of crankcase gases therethrough. The tube being spaced apart from an inner surface of the bore allowing oil to flow therethrough in an opposite direction relative to the crankcase gases.

BRIEF DESCRIPTION OF THE DRAWINGS

Advantages of the present invention will be readily appreciated as the same becomes better understood by reference to the following detailed description when considered in connection with the accompanying drawings, wherein:

FIG. 2 is an exploded perspective view of one stage of the oil separator of FIG. 1;

FIG. 3 is cross sectional view of a portion of the oil separator of FIG. 1;

DETAILED DESCRIPTION OF THE INVENTION

The invention provides an oil separator for removing oil from crankcase gases of an internal combustion engine. The oil separator according to the invention provides enhanced separation, collection and drainage of oil from crankcase gases. The invention improves over conventional designs by providing a plurality of stages through which crankcase gases are directed. A part of the oil is separated from the crankcase gases at each stage and provided a dedicated return path to the oil sump of the engine, which is separate from the path taken by the crankcase gases through the oil separator.

Figure 1:
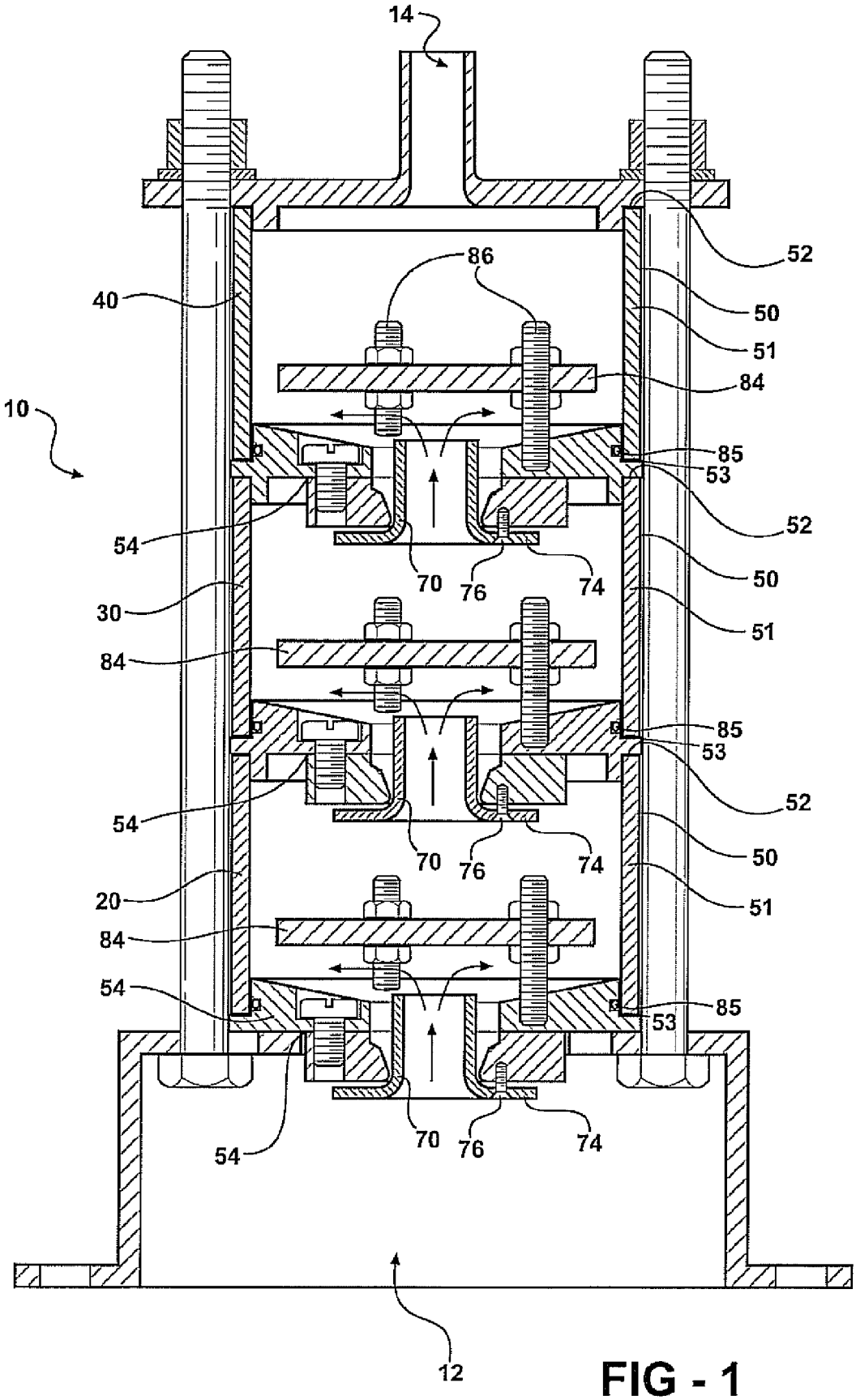
FIG. 1 is a cross sectional view of an oil separator according one embodiment of the invention.

Referring to FIGS. 1-3, an oil separator according to one embodiment of the invention is generally indicated at 10. The oil separator 10 includes a plurality of stages 20, 30, 40 positioned one over another in a single stack that extends between an inlet end 12 and an outlet end 14.

Each stage 20, 30, 40 includes a generally cylindrical side wall 51 that extends between a top face 52 and a bottom face 53. The bottom face 53 of the side wall 51 abuts an end wall 54. Optionally, a gasket or seal 55 may be positioned between the side wall 51 and the end wall 54 to prevent gases from leaking therebetween. Each end wall 54 includes opposite bottom 56 and top 58 surfaces. A bore 60 extends through each end wall 54. A lower end of the bore 60 is funnel-shaped with a diameter that increases from the bottom surface 56 toward the top surface 58 of the end wall 56. An upper end of the bore 60 is generally cylindrically shaped. The top surface 58 of the end wall 54 is funnel-shaped for directing oil flow to the upper end of the bore 60.

A generally cylindrical tube 70 extends through the bore 60. The tube 70 is fixedly secured to the end wall 54 by a bolt 76, or other suitable fasteners or fastening methods known by those having ordinary skill in the art. The tube 70 provides a path for crankcase gases to flow therethrough.

As best shown in FIG. 3, an upper end 72 of the tube 70 protrudes upwardly from the bore 60. A flange 74 protrudes outwardly from a lower end of tie tube 70. An outer surface 78 of the tube is spaced apart from inner walls 80 of the bore 60 and the flange 74 is spaced apart from the end wall 54 to define a continuous oil flow path 82 therebetween.

An impact wall 84 is fixedly secured to the end wall 54 by a bolt 86 or other suitable conventional fasteners or fixing methods. The impact wall 84 is spaced apart from the upper end 72 of the tube 70 by a predetermined distance to cause a pressure increase as crankcase gases exit the upper end 72 of the tube 70 and are deflected radially outwardly by the impact wall 84. The increase in pressure causes separation of oil from the crankcase gases. The separated oil collects along the funnel-shaped top surface 58. The oil then flows through the oil flow path 82 under the force of gravity with minimal or no interference by the crankcase gases passing through the tube 70, thus an increased drainage efficiency over conventional oil separator designs.

In use, gas from the crankcase enters the inlet end 12 of the separator 10. The gas flows through the tube 70 of the first stage 20 and is diverted radially outwardly by the plate 84. A local high pressure area is formed between the upper end 72 of the tube 70 and the plate 84, which results in separation of oil droplets from the gas. The oil collects along the top surface 58 and flows toward the bore 60. The oil enters the bore 60 and flows downwardly along the flow path 82 toward the flange 74. The oil then flows outwardly along the flange 74 and drips downwardly from the outer edges of the flange 74, The oil is then reintroduced into the sump for recirculation in the engine.

The gas moves from the first stage 20 and enters the tube 70 leading into the second stage 30 repeating the oil separation process described above in the first stage. Oil separated in the second stage eventually funnels through the bore 60 in the end wall 54 of the first stage 20 and is reintroduced into the sump for recirculation in the engine. The gas continues from the second stage 30 and enters the tube 70 leading into the third stage 40. Oil separated in the third stage funnels through the second 30 and first 20 stages and eventually empties into the sump for recirculation in die engine.

At each stage, oil is directed outwardly away from a center region of the stage below by the flange 74. This promotes more efficient draining of oil to the stage below and helps to minimize or prevent oil from rejoining the flow of crankcase gases into the stage from which the oil was separated. In this particular embodiment, the flange 74 extends along a plane that is generally orthogonal relative to a longitudinal axis of the tube 70. It should be readily appreciated that the flange may extend at other angles relative to the tube axis, as long as it extends outwardly enough to divert the oil away from the center of the stage below.

Thus, during the operation of the engine, crankcase gases are continuously flowing upwardly through the stages 20, 30, 40 of the separator 10, while the oil separated from the crankcase gases moves in the opposite direction through the oil separator 10 due to gravity.

Figure 4:
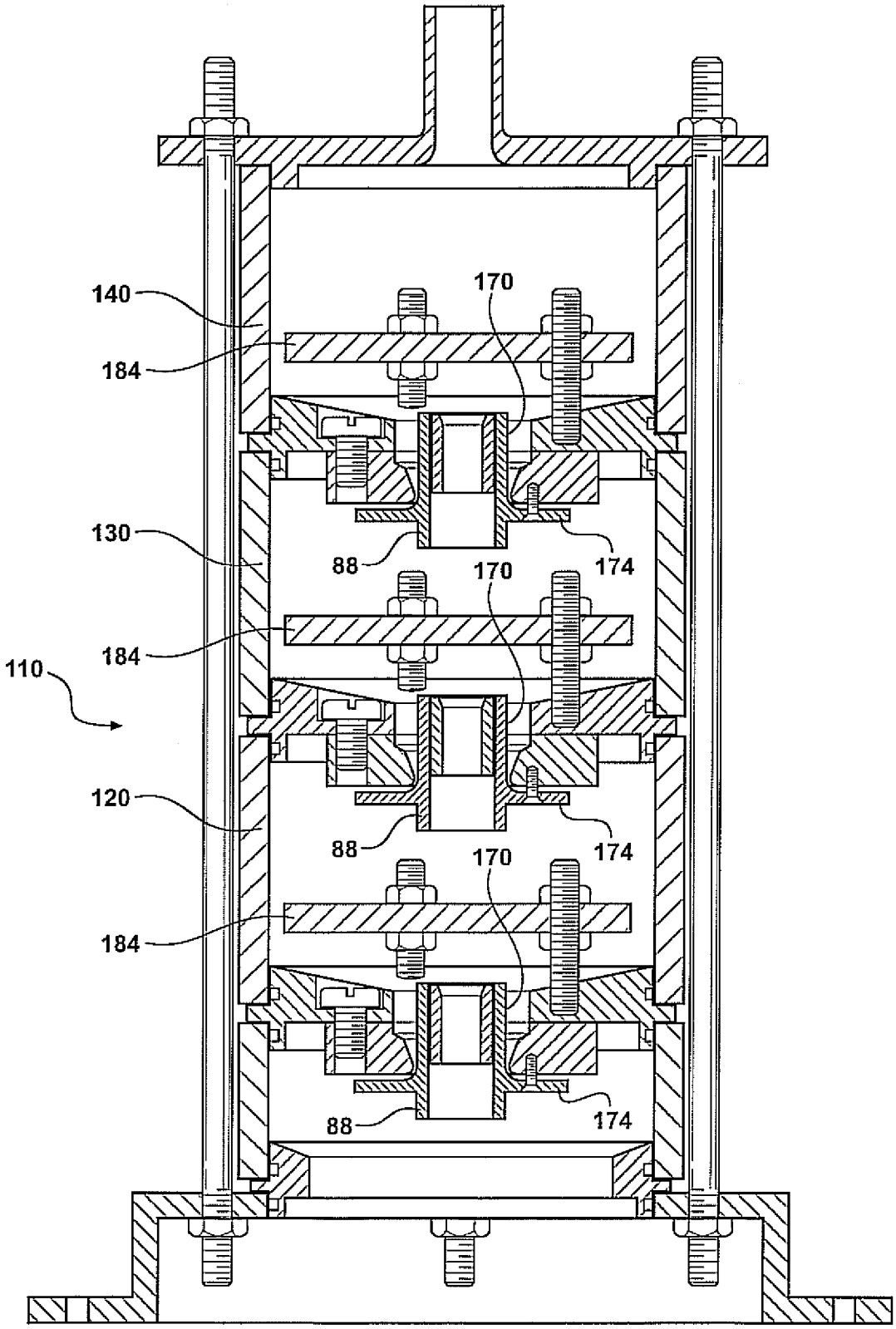
FIG. 4 is a cross sectional view of an oil separator according to a second embodiment of the invention.

Referring to FIG. 4, an oil separator according to a second embodiment of the invention is shown, wherein like parts are indicated by like numerals offset by 100. In this embodiment of the invention, a tubular neck 88 extends downwardly from the flange 174 opposite the tube 170. The neck 88 has substantially the same diameter as the tube 170. The neck 88 is generally coaxially aligned with the tube and defines a flow path for the crankcase gases continuous with the tube 170. The neck 88 prevents oil dripping from the outer edges of the flange 174 from re-joining the stream of crankcase gases entering the tube 170. Without the neck 88, the flow rate of the crankcase gases through the separator 110 is limited by the tendency of oil dripping from the flange 174 to be drawn back into the stream of crankcase gases entering die tube 170. The neck 88 allows for higher flow rates of crankcase gases through the tube 170, which in turn provides enhanced efficiency in the separation of oil due to a higher localized pressure at the impact plate 184.

Figure 5:
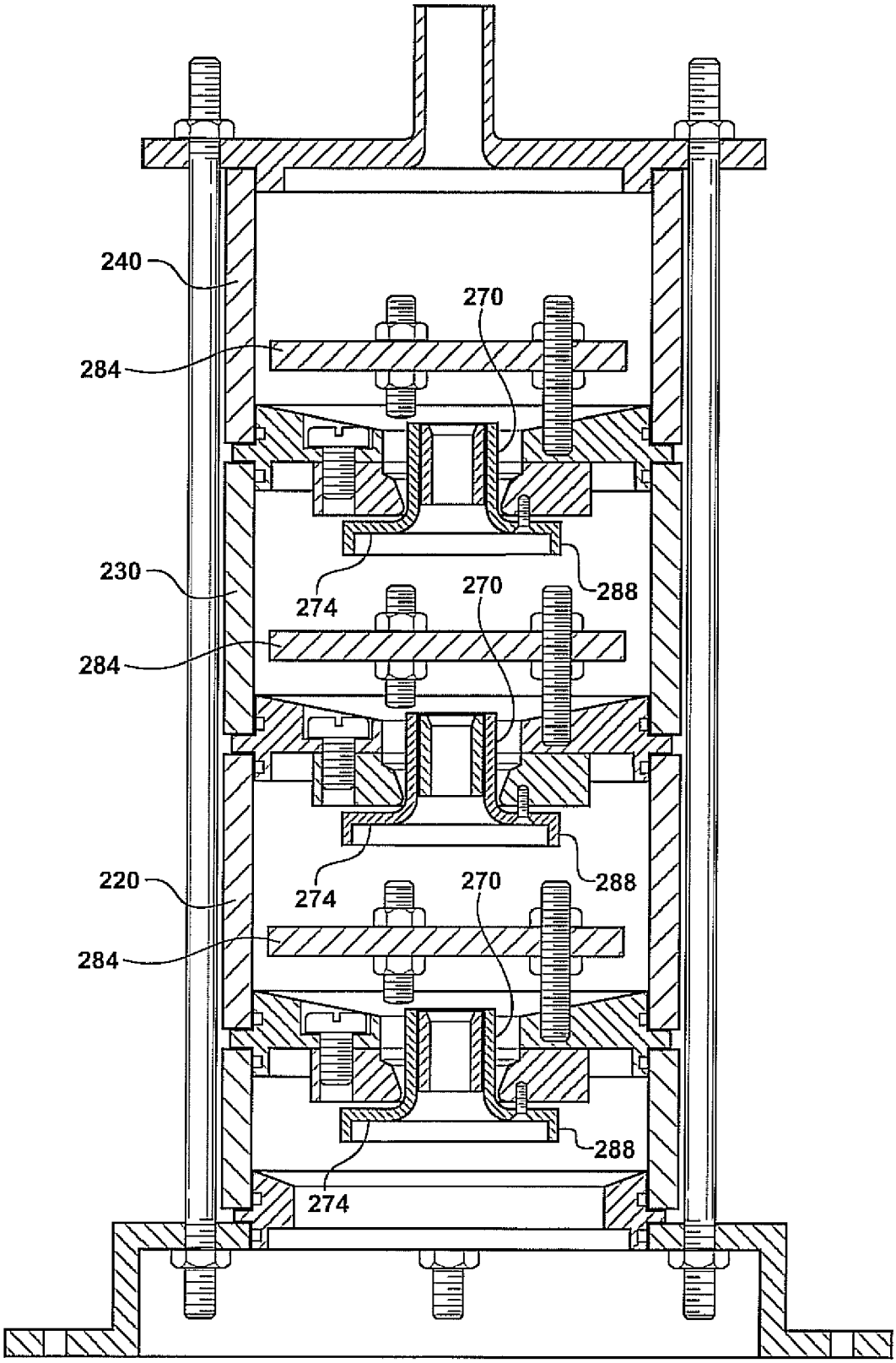
FIG. 5 is a cross sectional view of an oil separator according to a third embodiment of the invention.

A third embodiment of the invention is shown in FIG. 5, wherein the neck 288 has a larger diameter than the tube 270 and extends downwardly from an outer edge of the flange 274. As in the second embodiment, the neck 288 prevents oil dripping from the outer edges of the flange 274 from re-joining the stream of crankcase gases entering tie tube 270.

Figure 6:
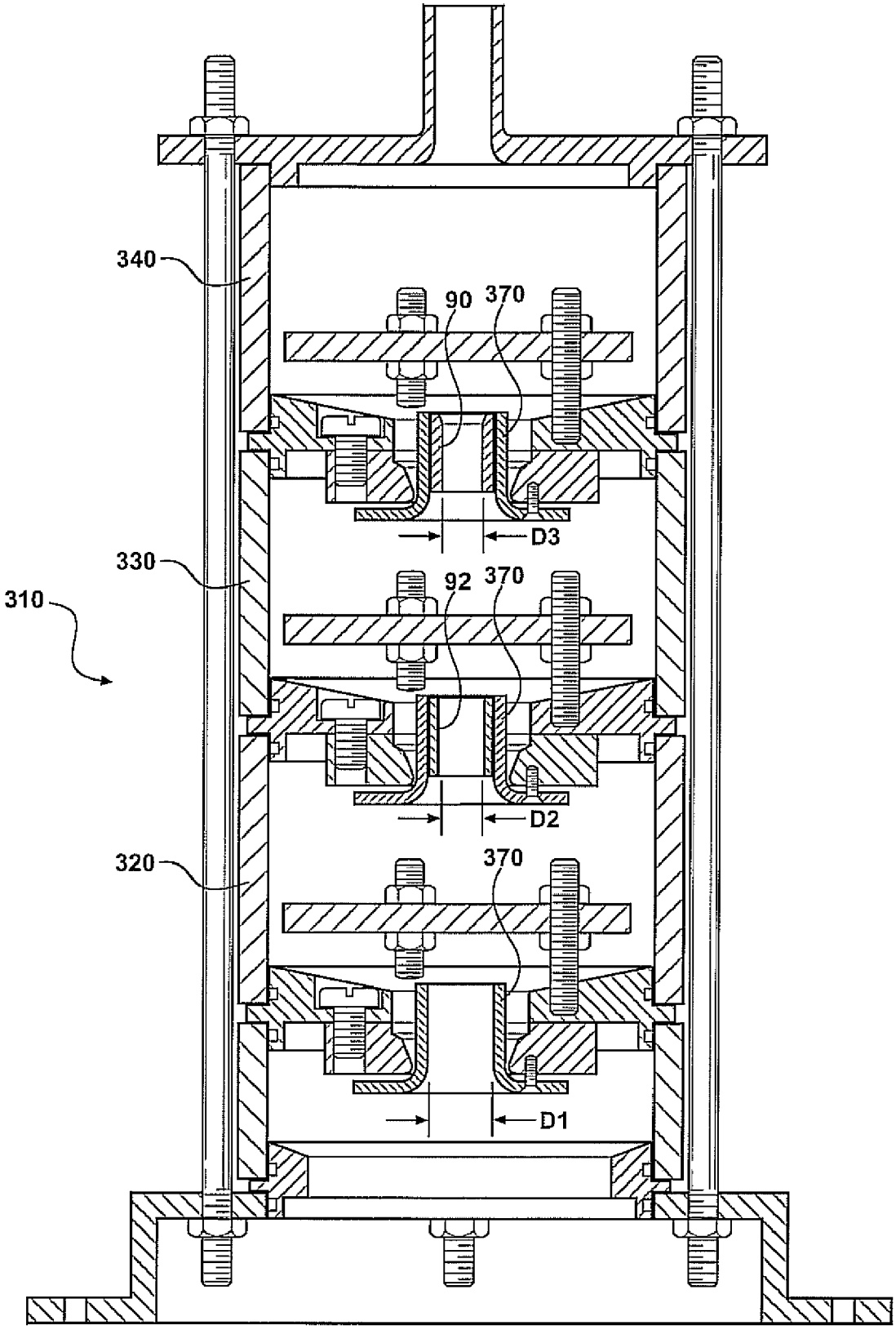
FIG. 6 is a cross sectional view of an oil separator according to a fourth embodiment of the invention.

A fourth embodiment of the invention is shown in FIG. 6, wherein the diameter of the flow path defined through the tube 370 decreases from one stage to the next. More specifically, the diameter D2 of the flow path in the second stage 330 is smaller than the diameter D1 of the first stage 320, and the diameter D3 of the flow path in the third stage 340 is smaller than the diameter D2 of the second stage 330. The smaller diameter results in higher velocity of the crankcase gases through the tube 370. Higher velocity in the later stages results in greater efficiency in the removal of small oil particles that were not removed in the earlier stages. Inserts 90, 92 are used for reducing the diameter of the flow path through the tubes 370, though it should be appreciated that the tubes may be formed with different diameters rather than utilizing the inserts.

Figure 7:
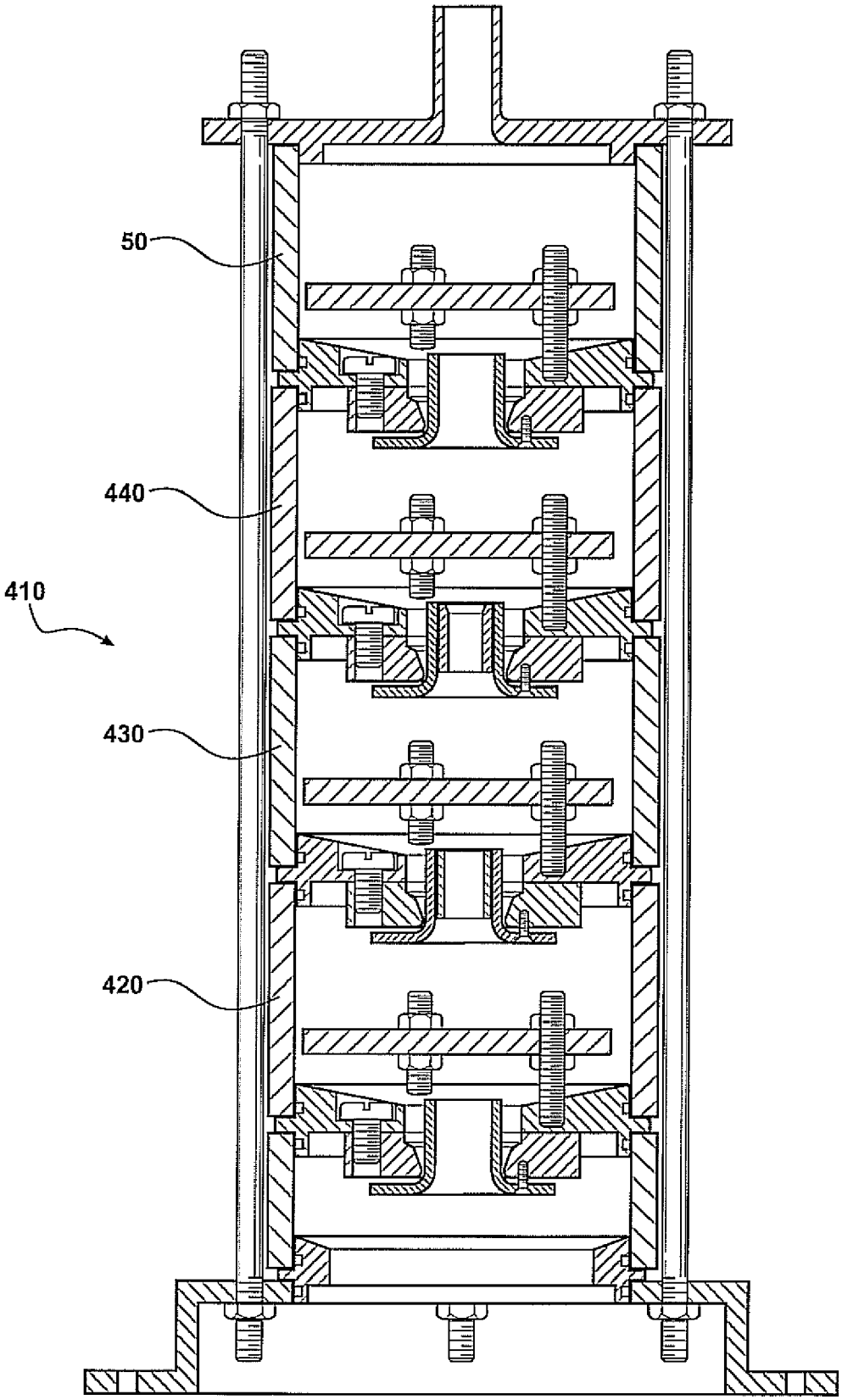
FIG. 7 is a cross sectional view of an oil separator according to a fifth embodiment of the invention.

It should be appreciated that the oil separator may have two stages or may have more stages than as shown in the previous embodiments. In FIG. 7, for example, a fourth embodiment of the oil separator 410 is shown, which includes a fourth stage 50 positioned on top of the third stage 430.

The invention has been described in an illustrative manner. It is, therefore, to be understood that the terminology used is intended to be in the nature of words of description rather than of limitation. Many modifications and variations of the invention are possible in light of the above teachings. For example, the side walls and ends walls of the various stages of the oil separator may be integrally formed as an injection molded part or coupled to each other using adhesives and/or other suitable fastener known by those having ordinary skill in the art. Thus, within the scope of the appended claims, it is clear that the invention may be practiced other than as specifically described.

The invention claimed is:

1. An oil separator for separating oil from crankcase gases of an internal combustion engine, said oil drainage device comprising:

an inlet;

an outlet; and a plurality of stages arranged in a stack between the inlet and the outlet, each stage comprising:

a generally upright side wall having opposite top and bottom faces;

an end wall disposed at the bottom face of the side wall, said end wall having opposite upper and lower surfaces, said end wall having a bore extending through the upper and lower surfaces for receiving a flow of crankcase gases therethrough;

a plate diverting the flow of crankcase gases exiting the bore for creating a pressure increase that separates oil from the crankcase gases;

a tube extending through the bore for directing the flow of crankcase gases therethrough, the tube being spaced apart from an inner surface of the bore allowing oil to flow therebetween in an opposite direction relative to the crankcase gases.

2. An oil separator as set forth in claim 1, wherein the tubes of each stage are coaxially aligned with each other.

3. An oil separator as set forth in claim 1, wherein at least one of the tubes has opposite upper and lower ends, the at least one of the tubes having a flange that extends outwardly from the lower end to direct oil away from a center region of a stage below.

4. An oil separator as set forth in claim 3, wherein the flange extends generally orthogonally relative to a longitudinal axis of the tube.

5. An oil separator as set forth in claim 3, wherein the at least one of the tubes includes a neck that extends outwardly from a side of the flange opposite the upper end of the tube for preventing oil from reentering the flow of crankcase gases through the tube.

6. An oil separator as set forth in claim 5, wherein the neck has substantially the sane diameter as the tube.

7. An oil separator as set forth in claim 1, wherein each tube has a flange that extends outwardly from a lower end thereof to direct oil away from a center region of a stage below.

8. An oil separator as set forth in claim 7, wherein at least one of the tubes includes a neck that extends generally orthogonally from the flange for preventing oil from reentering the flow of crankcase gases through the tube.

9. An oil separator as set forth in claim 1, wherein the tube in each stage has a diameter that is smaller than the diameter of the tube in a preceding stage.

10. An oil separator as set forth in claim 1, wherein the end wall includes a top surface that is angled downwardly relative to the side wall for directing oil toward the bore.

11. An oil separator as set forth in claim 1, wherein the bore has a generally cylindrical shaped upper end.

12. An oil separator as set forth in claim 11, wherein the bore has a generally funnel-shaped lower end.

* * * * *

UNITED STATES PATENT AND TRADEMARK OFFICE

CERTIFICATE OF CORRECTION

PATENT NO. : 7,380,545 B2
APPLICATION NO. : 11/533813
DATED : June 3, 2008
INVENTOR(S) : Tenghua Tom Shieh et al.

It is certified that error appears in the above-identified patent and that said Letters Patent is hereby corrected as shown below:

Column 1, line 24, replace “into die” with --into the--

Column 2, line 61, replace “of tie tube” with --of the tube--

Column 3, line 62, replace “die tube” with --the tube--

Column 5, line 10, replace “sane” with --same--

Signed and Sealed this

Twelfth Day of August, 2008

JON W. DUDAS
*Director of the United States Patent and Trademark Office*